US005660057A

United States Patent [19]

Tyree, Jr.

[11] Patent Number: 5,660,057

[45] Date of Patent: Aug. 26, 1997

[54] CARBON DIOXIDE RAILROAD CAR REFRIGERATION SYSTEM

[76] Inventor: Lewis Tyree, Jr., 115 Liberty Hall Rd., Lexington, Va. 24450

[21] Appl. No.: 688,413

[22] Filed: Jul. 30, 1996

[51] Int. Cl.[6] ..... F25D 3/12

[52] U.S. Cl. ..... 62/384; 62/388; 62/339

[58] Field of Search ..... 62/384, 388, 239, 62/66

[56] References Cited

U.S. PATENT DOCUMENTS

| | | | |
|---|---|---|---|
| 1,873,131 | 8/1932 | Josephson | 62/388 X |
| 1,980,089 | 11/1934 | Rice, Jr. | 62/388 X |
| 2,313,120 | 3/1943 | Bonsall | 62/388 X |
| 2,321,539 | 6/1943 | Zeidier . | |
| 2,550,935 | 5/1951 | Pike | 62/384 X |
| 3,561,226 | 2/1971 | Rubin | 62/66 |
| 3,864,936 | 2/1975 | Frank et al. | 62/385 |
| 4,206,616 | 6/1980 | Frank et al. | 62/384 X |
| 4,299,429 | 11/1981 | Franklin, Jr. | 62/384 X |
| 4,498,306 | 2/1985 | Tyree, Jr. | 62/384 X |
| 4,502,293 | 3/1985 | Franklin, Jr. | 62/388 |
| 4,593,536 | 6/1986 | Fink et al. | 62/239 |
| 4,704,876 | 11/1987 | Hill | 62/388 |
| 4,761,969 | 8/1988 | Moe | 62/388 |
| 4,891,954 | 1/1990 | Thomsen | 62/388 X |
| 4,951,479 | 8/1990 | Araquistain et al. | 62/239 |
| 5,074,126 | 12/1991 | Mahieu | 62/388 |
| 5,152,155 | 10/1992 | Shea et al. | 62/388 X |
| 5,168,717 | 12/1992 | Mowatt-Larssen | 62/239 |
| 5,415,009 | 5/1995 | Weiner et al. | 62/239 |
| 5,423,193 | 6/1995 | Claterbos et al. | 62/384 |
| 5,460,013 | 10/1995 | Thomsen | 62/239 |

FOREIGN PATENT DOCUMENTS 399678 10/1933 United Kingdom .

OTHER PUBLICATIONS

Quinn and Jones, Carbon Dioxide, 1936, pp. 220–240 American Chemical Society, Monograph Series, Reinhold Publishing Corporation.

*Primary Examiner*—Christopher Kilner

[57] ABSTRACT

The cargo area of a refrigerated box car is cooled by convectors positioned along the upper side and end walls of the cargo compartment of the car. The convectors are cooled by a supply of carbon dioxide snow in a bunker above the cargo compartment.

16 Claims, 11 Drawing Sheets

A END

B END

A END

B END

CARBON DIOXIDE RAILROAD CAR REFRIGERATION SYSTEM

CROSS REFERENCE TO RELATED APPLICATIONS

Priority for the present invention is based upon prior filed Provisional patent application, Ser. No. 60/014,494 of Lewis Tyree, Jr. entitled CARBON DIOXIDE RAILROAD CAR REFRIGERATION SYSTEM filed on 1 Apr. 1996 and Provisional patent application Ser. No. 60/016,651 of Lewis Tyree, Jr. entitled CARBON DIOXIDE RAILROAD CAR REFRIGERATION SYSTEM filed on 21 Jun. 1996. Also Document Disclosure 389,797 disclosing the present invention was filed on Jan. 23, 1996

BACKGROUND—FIELD OF THE INVENTION

This invention relates to an on-board solid carbon dioxide or dry ice refrigeration system for railroad cars (railcars) and more particularly to the construction and methods of use of the dry ice bunker and the freight storage compartment when utilizing carbon dioxide as an expendable refrigerant in transporting products by railroad cars but also useful for other substantially sized vehicles such as trucks, trailers, containers and the like being moved over substantial distances or in circumstances where enroute cold temperature protection is essential, and in an arrangement where no mechanical refrigeration device is included, principally using bunker placement, natural phenomena and insulation choice and techniques to maintain the cargo in the refrigerated state, and especially useful to that cargo in the frozen state.

BACKGROUND—DESCRIPTION OF BACKGROUND ART

A number of systems utilizing the refrigeration of both dry ice blocks or dry ice snow (both a form of solid carbon dioxide), and gaseous carbon dioxide, resulting either from the depressurization or flashing of liquid carbon dioxide, or from sublimation of the already formed dry ice for cooling in transit containers or vehicles, have been proposed heretofore and many are described in Chap. VIII of "Carbon Dioxide", a monograph of The American Chemical Society by E. L. Quinn and C. L. Jones, published in 1936 by Reinhold Publishing Company, New York, N.Y. Examples of such early basic systems were those proposed in Martin U.S. Pat. No. 1,752,277 issued Mar. 25, 1930; in Kurth U.K. Pat. No. 399,678 accepted Oct. 12, 1933; in Thoke U.S. Pat. No. 1,935,923 issued Nov. 21, 1933; and more recently in Rubin U.S. Pat. No. 3,561,266 issued Feb. 9, 1971; in Frank U.S. Pat. No. 3,864,936 issued Feb. 11, 1975; and in Franklin U.S. Pat. No. 4,299,429 issued Nov. 10, 1981. In the Rubin patent, carbon dioxide liquid was flashed within a metal container located at the top of the vehicle storage area so as to form dry ice snow within the container. The lower surface of the container became cold enough to cool the interior of the vehicle storage area and also the resultant carbon dioxide vapor escaped from one or more vents from the container optionally into the storage area so as to aid in cooling. All such systems, where the refrigerant is used up in providing the cooling effect are referred to as expendable systems and the refrigerant as an expendable refrigerant. If no fans or blowers are provided, the systems are referred to as "passive systems", as opposed to those with fans or blowers which are referred to as "active systems". If in addition to no fans, there are no mechanical devices of any kind, it is also referred to as a "no moving part system".

Rather than attempt to generally cool the general/overall cargo volume as in Rubin and the others, more recent practice for transporting refrigerated foods, whether the cooling is from an expendable refrigerant or the result of a mechanical system, where a densely packed, heavy cargo occurs, and thus where cold air or carbon dioxide vapor can not circulate through the cargo itself, is to arrange for circulation around the periphery of the cargo, and thus protection is provided by intercepting the heat from the outside before it can warm the cargo. Mechanical refrigeration type in transit refrigeration devices typically provide very active circulation by the use of blowers to circulate cold air so as to encircle all cargo outer surfaces. This of course requires fans, vehicle interior construction and cargo loading methods so as to achieve adequate and properly directed air circulation. Thousands of mechanical refrigeration railcars were used in the U.S., but today the advent of fast, through freight trains have made their enroute repair needs into a major drawback. One method of cooling such railcars is disclosed in Black U.S. Pat. No. 2,923,384 issued Feb. 2, 1960 in a floor, top and sides through which mechanically refrigerated air may be circulated.

A number of patents disclose passive periphery gaseous circulation around the cargo caused by solid carbon dioxide, i.e.: in Bonine U.S. Pat. No. 1,880,735 issued Oct. 4, 1932; in Martin U.S. Pat. No. 1,752,277 issued Mar. 25, 1930; in Zeidler U.S. Pat. No. 2,321,539 issued Jun. 8, 1943; in Hall U.S. Pat. No. 2,508,385 issued May 23, 1950; in Lindersmith U.S. Pat. No. 3,206,946 issued Sep. 21, 1965; and more recently in Franklin U.S. Pat. No. 4,299,429 issued Nov. 10, 1981. Franklin U.S. Pat. No. 4,502,293 issued Mar. 5, 1985 is an example of a carbon dioxide system for containers wherein a temperature responsive damper valve controls the circulation and thus the temperature of the container, i.e. either fresh (non-frozen) or frozen temperature. However when totally passive (no moving parts) techniques were applied to containers as large as railroad cars using expendable refrigerants (as in Fink, et al U.S. Pat. No. 4,593,536 issued Jun. 10, 1986), the density differences and the methods utilized produced proved insufficient to cause effective peripheral circulation. A different approach is disclosed in Mahieu U.S. Pat. No. 5,074,126 issued Dec. 24, 1991 wherein the very cold temperature of solid carbon dioxide is used to create density differences within the refrigerated chamber sufficient to create jets of cold vapor essentially cooling the entire chamber.

The table below illustrates the useful density differences of carbon dioxide vapor using the temperature range actually available. Temperatures warmer than +20° F. are dangerous to use with frozen foods, as partial thawing of many food products occur in the +20° F. to +30° F. range.

$CO_2$ Densities at Various Temperatures and One (1) Atmosphere Pressure
Relative density of $CO_2$ vapor at various temperatures and 1 atmosphere pressure compared to its density at 0° F.

| Temp 0° F. | Density in lb/Ft$^3$ | Difference from 0° F. - % |
|---|---|---|
| −110 | 0.173 | +31 |
| −80 | 0.162 | +23 |
| −60 | 0.153 | +16 |
| −40 | 0.145 | +10 |
| −20 | 0.139 | +5 |
| 0 | 0.132 | 0 |
| +20 | 0.127 | <4> |
| +40 | 0.122 | <8> |

NOTE: Data from ASHRAE, Table 40, Refrigerant 744.

Hill U.S. Pat. No. 4,704,876 issued Nov. 10, 1987 is an example of a more complete carbon dioxide cooling system than that disclosed by Fink. The entire system was designed primarily for frozen foods, say in the range of −20° F. to +20° F., but commonly referred to as a 0° F. system and is suitable for larger cargo volumes and longer trips, where carbon dioxide snow is deposited within a large lengthwise compartment or bunker located at the top of the cargo area, commonly referred to as an attic bunker. This attic bunker prevents heat incursion through the roof by intercepting it before the heat reaches the cargo. In addition, the bunker is constructed so that both the carbon dioxide flash gas or vapor created when filling the lengthwise bunker with dry ice snow using liquid carbon dioxide, and the gas or vapor created as that snow gradually sublimes, exits the bunker at about −110° F. through bunker vents located all around and adjacent to the side and end walls of the cargo area. During bunker filling, with the cargo loaded, the doors closed and the exit vent open, the flash vapor forms what can be called a curtain or envelope of cold carbon dioxide vapor passing sequentially between the frozen cargo and the four side walls and then the floor, as the vapor seeks the car's exit vent. These side walls and the floor are corrugated with grooves or channels open to the interior, all in a manner so that once the car is loaded with cargo, the walls, the floor and the cargo cooperatively effectively form a multi-channeled duct system, down the side walls and then out through the floor to the exit vent. This curtain concept functions very well at the very high vapor flow rates occurring during bunker filling but very poorly after that (enroute) at the very low vapor flow rates resulting from the gradual sublimation of the dry ice in the bunker. However, the fast moving curtain of $CO_2$ created by using the exiting −110° F. vapor during bunker filling tends to sub-cool both the inside surfaces of the walls and floor and the outside surfaces of the frozen food adjacent to those surfaces, thus the walls, some of the food and especially the floor providing a heat sink to help intercept future heat incursions as they occur. The initial heat incursion may result from the railcar itself, even if it had been pre-cooled before loading, but had not had sufficient time to become fully cold soaked, a normal condition for such cars primarily used in long-distance, one direction refrigerated service. The next, and principal heat incursion results enroute from ambient conditions, including the suns radiant effect, track heat, etc. The lengthwise bunker itself tended to intercept heat incursion through the car roof, where the suns radiant load is most severe, some of the dry ice in the bunker subliming in the process. The bottom surface of the bunker tended to maintain the top of the cargo area cool during a typical twelve day in-transit period, again, the dry ice in the bunker gradually subliming in the process. Since $CO_2$ vapor, which fills the railcar, is denser when cold, natural circulation of warm vapor up to the bottom surface of the bunker, and cold vapor down in the railcar then occurs. In addition, the just sublimed −110° F. vapor exits the bunker through vents adjacent to the side and end walls and tends, being very dense, to fall to the floor before exiting the railcar. By all these means, it was attempted to maintain all the contents of the storage area within desirable temperature limits during shipment.

The Hill or similar cars have found use on long hauls, such as shipping frozen potatoes slices (for subsequent French Frying) and other frozen foods from the U.S. West Coast to the Midwest or East Coast, as there are absolutely no moving parts in the refrigeration system to malfunction enroute. Such no moving part (totally passive) systems can be included in long haul, through trains without fear of refrigeration system failure enroute. In earlier mechanical refrigerated railroad cars, such malfunctions had become a major problem for the railroads, as stopping an entire train to repair one car's refrigeration system became unreasonably burdensome, especially when compared to an individual truck's ability to drive to a repair shop. This no moving part zero maintenance feature is also useful for other type vehicles or containers where enroute repairs are inconvenient or impossible, such as trucks, trailers or containers for rail, air or water shipment.

The Hill cars function, thermodynamically speaking, by typically expanding nominal 0° F. liquid carbon dioxide for the bunker filling which results in approximately 53% of the incoming liquid carbon dioxide flashing to vapor, with the remainder becoming dry ice snow within the bunker. With the car doors closed and the exit vent open, this flash vapor at −110° F., is forced by pressure differential down through the bunker vents initially into the volume just above the cargo, acting as a plenum or dispersal chamber, then separating so as to proceed down all the side walls through the channels in the side and end walls, thence under the cargo through passages in the floor enroute to the exit vent and thence to the atmosphere, in the process sub cooling both the cargo side of the walls and the floor and the product adjacent. Assuming using 12 tons of liquid carbon dioxide, as Hill states, and a 30 minute bunker fill time (800 lbs/min), a typical time, a flash rate of approximately 425 lbs./min. of vapor occurs. At −110° F., approximately 2,500 cfm of vapor results, and the volume increases somewhat as the vapor warms up enroute to the exit vent. Typically, less than 5 psig pressure is desired within the car so as to prevent structural damage, and accordingly the time of filling is lengthened if any of the vents or the channelized gaps between the side walls, the floor and the freight are insufficient in size to accommodate the volume of vapor being created without excessive pressure rise between the bunker and the exit vent. The percent given above for vapor and solid resulting from expanding carbon dioxide are theoretical and for 0° F. liquid, the use of colder liquid results in a lower percent flashing to vapor. In addition, practical results may vary, as in most cases, very small particles of dry ice snow are carried out of the bunker with the high velocity vapor, a type of dry ice snow generally called "float". The exact amount of float varies for a number of reasons, including the geometry of the orifice bore through which the carbon dioxide liquid expands, the temperature of the liquid carbon dioxide and whether an expansion snow horn is provided, as well as the geometry of the snow deposit area in the bunker and the location of the vapor vent path.

However, there are certain serious deficiencies in the Hill system. One principal deficiency is that once the bunker is filled and enroute to the car's destination, the total amount of carbon dioxide vapor being created by sublimation of dry ice in the bunker is so greatly reduced that the resultant sublimed vapor movement is almost inconsequential. For example, on Hill's 12 day trip, the 47% of the original liquid carbon dioxide which becomes dry ice snow in the bunker (11,250 lbs); sublimes at about an approximate average rate of ⅔ lb./min. or only approximately 4 cfm of vapor, a reduction of over 99% from that when filling the bunker. With that small amount of vapor, a constantly downwards moving curtain of exiting cold vapor (as occurs during bunker filling) is not formed around the side walls, the vapor leaving the bunker area by whatever vent(s) happen to be lowest at the moment according to track orientation. In addition, in most cases, the exit vent is closed enroute so as to reduce harmful air flow through the car by creating a slight positive pressure, making reliable cooling of the walls and floor enroute by exiting vapor virtually impossible, as the exiting vapor will find the shortest route from the railcar, usually through door seals, floor drains, etc.

Accordingly, the vast majority of the enroute cooling is provided from the dry ice sublimation, moving through the bunker floor (at a rate reflecting the amount of insulation) to cool the cargo ceiling, which in turn provides cooling for the cargo area. Again, while the cold ceiling will cool any warm vapor that rises to it, the resultant cooled vapor will tend to run downward to whatever portion of the top of the cargo that happens to be lowest at that minute according to either or both the cargo loading arrangement and the track orientation.

Another deficiency of Hill is that it can be seen that the amount of insulation between the bottom of the bunker and the top of the cargo area must be chosen so the refrigeration provided by the bunker to the entire cargo area, also considering the effect of the sublimed vapor—even though small, reflects a balance between the total and daily heat load anticipated for the car, the time/length of the anticipated in transit period and other relevant factors, but once the car is built, these factors cannot be readily changed so as to reflect the seasonal or enroute differences in heat load. However, it should be noted that any heat incursion through the roof, whatever it may be, is intercepted by the bunker directly and the appropriate amount of dry ice sublimes. A related deficiency is in the poor distribution of the enroute sublimation cooling through the bunker floor. It is a goal of this type of frozen food transportation to maintain all the food at precisely the proper temperature, that is to not further cool any portion nor allow any portion to warm up, difficult in a passive system, and especially where the heat incursion is greater in some areas than in others, which thus require more replenishment refrigeration. Examples of high heat incursion areas are the door and the door frame areas, the corners, the floor and the roof. However, depending upon the heat transmission through the bunker floor from the dry ice in the bunker to cool the cargo area means the ceiling of the cargo area becomes like a cold plate. Thus the entire top layer of cargo, which requires no protection other than the bunker, becomes too cold, wasting refrigeration and causing excessive dry ice consumption. This type frozen food is typically small pieces which are I.Q.F. (Individually Quick Frozen) and loose packed in cartons, thus even if only localized warming occurs enroute, the contents of that carton not only suffers quality deterioration, but the contents form one single mass upon refreezing, an undesirable situation. If excessive refrigeration is supplied enroute, resulting in overfreezing of some cartons or reducing the temperature of portions of the car, carbon dioxide is wasted, but only in some limited cases does physical deterioration of the food or packaging also result. These localized temperature control deficiencies are shared by many other dry ice cooling systems, especially the no-moving part/totally passive systems.

The problem of insulating the structure of the car floor is exacerbated in that requiring 53% of the entering liquid carbon dioxide to even partially sub-cool the floor during filling of the bunker may prevent the use of −50° F. or −60° F. liquid carbon dioxide. Such colder liquid carbon dioxide could form the same amount of snow in the bunker, with an approximate 20% reduction in total carbon dioxide use. An example of a system to provide colder liquid carbon dioxide is in U.S. Pat. No. 4,888,955 issued to the present inventor. If one were to do such, the reduction is net from the flash vapor created, thus reducing the flash vapor available for initial sub-cooling of the walls and floor by approximately ⅓, in most cases an undesirable situation. Of the total refrigeration provided by 0° F. liquid carbon dioxide, approximately 7% is in the flash vapor, 86% in the subliming dry ice and 7% in the sublimed vapor, assuming all the vapor exits the car warmed to about −30° F.

The following table illustrates some of the unique characteristics of liquid carbon dioxide when expanded to snow (solid carbon dioxide or dry ice) and vapor, especially the very significant difference in refrigeration potentials of the snow and vapor which form the basis for this invention.

A) Approximate theoretical results (weight and volume) of expanding isenthalpically (flashing) 800 pounds of saturated liquid $CO_2$ at two equilibrium temperatures (°F.) to solid (dry ice snow) and vapor (flash gas) at atmospheric pressure, and refrigeration potentials of each element thereof, and B) a comparison of using 0° F. or −60° F. liquid $CO_2$ for producing the same weight of solid $CO_2$.

| | | A of equal weights of liquid $CO_2$ @ two saturation temps | | B producing equal weights of solid $CO_2$ | | |
|---|---|---|---|---|---|---|
| 800 lbs. @ F. | | 0° F. | −60° F. | 800 lbs @ 0° F. | 648 lbs @ −60° F. | Δ% <19> |
| a) by weight | solid | 376 | 480 | 376 | 376 | 0 |
| lbs @ −110° F. | flash vapor | 424 | 320 | 424 | 272 | <36> |
| b) by volume | solid | 9.4 | 12.0 | 9.4 | 9.4 | 0 |
| CF @ −110° F. | flash vapor | 2,500 | 1,880 | 2,500 | 1,600 | <36> |
| c) by refrigeration potential | | | | | | |
| @ −110° F., BTU (sublimation) | solid | 91,700 | 117,100 | 91,700 | 91,700 | 0 |
| −110° F. to −20° F., | flash vapor | 8,050 | 6,080 | 8,050 | 5,170 | <36> |
| BTU (sensible) | sublimed vapor | 7,140 | 9,120 | 7,140 | 7,140 | 0 |

NOTES:

1)Data from Liquid Carbonic T-S Chart, form 6244, and ASHRAE Table 40, Refrig. 744.

2)Volume of solid is an average (40 lbs/ft$^3$), as snow's density (like water snow's) varies as a function of how formed.

In an earlier attempt to maintain the cargo adjacent to the floor in a uniform frozen state, a railroad car was built with lengthwise storage tubes, carrying liquid carbon dioxide stored at approximately 0° F. under 300 psig pressure, as part of the flooring system. These tubes both prevented heat incursion through the floor and supplied liquid carbon dioxide for injection above the cargo in response to a thermostat. However, the complexity, the extra weight and cost of pressure tubes when compared to an open bunker was not attractive, and only one car is known to have been so constructed.

Certain European shippers pre-sub cooled their cargo, well below the normal frozen food temperature in an attempt to have their food cargo itself provide thermal ballast, but isolated spots of excessively warm cargo resulted, as heat transfer within the cargo mass is usually too slow to provide the refrigeration to the points of heat incursion when needed.

Other patents disclosing dry ice concepts include: U.S. Pat. No. 4,761,969 to Moe; U.S. Pat. No. 4,891,954 to Thomson; U.S. Pat. No. 4,951,479 to Araquistain et al; U.S. Pat. No. 5,152,155 to Shea et al; U.S. Pat. No. 5,168,717 to Mowatt-Larssen, which describes a floor with convoluted passageways in an attempt to improve the floor pre-sub cooling and cooling; U.S. Pat. No. 5,323,622 to Weiner et al; U.S. Pat. No. 5,415,009 to Weiner et al, which describes a car with insulation directly under the cargo and between the exiting bunker flash gas, so as to cool the floor but not freeze the cargo for non-frozen cargo applications; and U.S. Pat. No. 5,423,193 to Claterbos et al, which describes a heavily insulated bunker floor so as to provide lengthened in transit times.

SUMMARY OF THE INVENTION

It is an object of the present invention to provide an improved railcar or shipping container for refrigerated goods, such as frozen food, utilizing adjustable cold convectors in the ceiling of the cargo area and adjacent to the side and end walls, forming part of the bunker, the bunker filled with dry ice, for enroute refrigeration. It is especially useful for larger containers, for example containers of over 600 cubic feet internal cargo volume. The containers are normally used in point to point service, that is one shipper and one destination. The cold convector system can be adjusted prior to loading the car to either increase or decrease the rate of vapor being cooled and consequent dry ice sublimation enroute. The cold convectors are thermally connected to the bunker floor, which is made of a material with high thermal conductivity. This better control provides two benefits. First, better temperature control improves the quality of foodstuffs; and second, better temperature control significantly reduces the amount of dry ice required.

Certain passive refrigerated but nonfrozen items, such as orange juice, could be shipped as well. One option is to close the bunker's vents to the cargo space, open an optional exit vent and thus provide a cargo space that does not have carbon dioxide vapor in it. In addition, a method is shown for pre-cooling the car, or re-cooling enroute, if required.

More particularly, it is an object of the invention to provide a railroad car construction utilizing carbon dioxide snow as the refrigerant and a railroad car bunker—adjustable cold convector system that can be arranged to be more suited to various enroute conditions likely to be encountered than the Hill, Moe, Fink, Shea, Mowatt-Larssen, Araquistain and Claterbos patents disclose; and at the user's option. By these means, all the contents of the car can be better maintained within acceptable limits during shipment and less carbon dioxide will be required.

In accordance with the illustrated embodiment, a railroad car heavily insulated on all sides is provided with a lengthwise bunker at its top in which a deposit of carbon dioxide snow is located. The bottom of this bunker is provided with a series of lengthwise center openings, through which both the flash and the sublimed carbon dioxide vapor may escape and a varying size, near −100° F., cold convectors around the periphery of the bunker floor, all so arranged to encourage natural convection around the four walls, where it is most required and not directly through the bunker floor. The side, upper surface, of the bunker floor on which the snow rests preferably will be constructed of a high heat conductive material, such as iron, steel, aluminum or copper, and of sufficient thickness so as to facilitate maintaining the cold convectors very cold, even as the snow in the bunker sublimes away from the cold convector area. While a highly conductive material such as copper can be a thinner upper surface and cold convector than one of iron or steel, the minimum desired thickness is 1/32". The portion of the bunker bottom away from the cold convector portion is heavily insulated on the cargo side, so as to minimize heat transfer there, not being needed there, as the top surface of the cargo is not subject to heat incursion, being protected by the bunker itself. It is desirable that the heat transfer through the insulated portion of the bunker floor be arranged to be less than 0.05 BTU/hr/Ft$^2$/°F. and through the cold convector portion of the bunker floor be arranged (when fully opened) to be at least more than 0.50 BTU/hr/Ft$^2$/°F. The area of cold convector exposed to the car's interior can be adjusted by dampers so as to accommodate a number of variables. For instance, larger or smaller effective cold convector surface areas can be provided above side wall portions expected to experience higher or lower heat incursion rates, or to adjust seasonally for the different heat incursion anticipated in winter or summer or to adjust for the difference in heat incursion when carrying 0° F. cargo vs. 35° F. cargo, or a combination of these. A favored arrangement is to space the cold convectors, so as to create alternate down and up drafts with the vapor along the side walls, the up drafts occurring as a result of heat incursion, the down drafts as a result of the cooling from the cold convectors. Each of the car's four side walls provide corrugations or channels open to the interior sufficiently sized so as to permit the downward flow of the very cold vapor towards the floor and the upward flog of the displaced warmer vapor towards the ceiling and both along the outer surface of the load. Thus enroute or other times of low vapor generation rates, vapor warmed by heat incursion primarily through the walls can rise in some of those channels, be cooled by the cold convector (which is kept cold by the dry ice in the bunker), and thence fall back down other channels, all as caused by natural convection resulting from density difference and enhanced by the cooperative location of the bunker's cold convectors close to the walls' corrugations. Any vapor created from the dry ice's sublimation adds to the effect.

An option, not shown in the drawings, is to provide a small vapor drain hole in the cooling section of each of the cold convectors adjacent to a corner (4) of the railcar. Each drain hole directly communicates with the dry ice in the bunker at a lower elevation than the center vapor vents and each drain holes cross-sectional area is less than 1% of the total cross-sectional area of all the center vapor vents combined. By this means, the vapor created by sublimation enroute tends to add to the cooling effect in one or more corners, depending upon the physical orientation of the railcar at that moment.

The car's roof, its bunker floor and the car's cargo floor may be composed partially of high R superinsulation vacuum panels of the type known as AURA™ panels of the Owens-Corning Fiberglass Corporation or similar panels from other manufacturers. AURA panels are of a type that are flat and of various dimensions, i.e. two feet by eight feet by one half inch thick, and contain an insulating core. The panels are capable or supporting a compressive load without significant deflection. The insulating core is encapsulated in a non permeable skin and evacuated to less than one psig. R insulation values of more than 10 result as compared to wood which has an R Value of approximately one. AURA type vacuum panels have benefits beyond their insulating abilities in this railroad car including: a reduction in $CO_2$ use and allowing more space for the cargo, which frequently fills the car before the weight limit is reached. Accordingly, the side walls, floor and roof can benefit from inclusion of AURA panels in their construction. Another significant use of AURA is their incorporation into the bottom of the bunker, so as to reduce the amount of refrigeration passing through to the interior of the car, except through the cold convectors, which are located where the refrigeration is desired. Thus, three benefits occur, one being space saving, another occurring where the balance between in transit time, heat leak of the car and bunker size requires lower sublimation rates and the third in reducing the heat transfer by radiation to the top surface of the cargo, where none is required, being protected by the bunker itself.

As a further aid to intercepting any heat attempting to pass through the floor to the adjacent cargo, by both sub-cooling the floor during bunker charging and enroute, an alternate arrangement could provide one or more passageway(s) direct from the bunker to and through the floor to the exit vent. One choice would be too arrange a vent passageway down one end of the car, communicating to the floor channels, and after passing through the channels, thence to the exit vent. If the exit vent is closed enroute, thence back into the car after passing through the floor. Another choice could be to vent the vapor down both ends of the car, then each vapor stream under ½ the floor lengthwise to two exit vents. Such arrangements, where the vapor vents from the bunker to the atmosphere without passing through the cargo compartment are useful when it is desired to transport refrigerated products and not expose them to carbon dioxide vapor, for instance many leafy vegetables. In such cases, it may be desirable to provide cooperatively shrouded tops for the side and end wall channels to match both the outlets and inlets (or one or the other) of the cold convectors, thereby enhancing circulation. Similar choices or variations or combinations could be provided for trailers or containers.

A BRIEF DESCRIPTION OF THE DRAWINGS

FIG. 1, in one embodiment, is a perspective view partly broken away of a refrigerated railroad car incorporating the present invention.

DETAILED DESCRIPTION OF THE PREFERRED EMBODIMENTS

Figure 1:
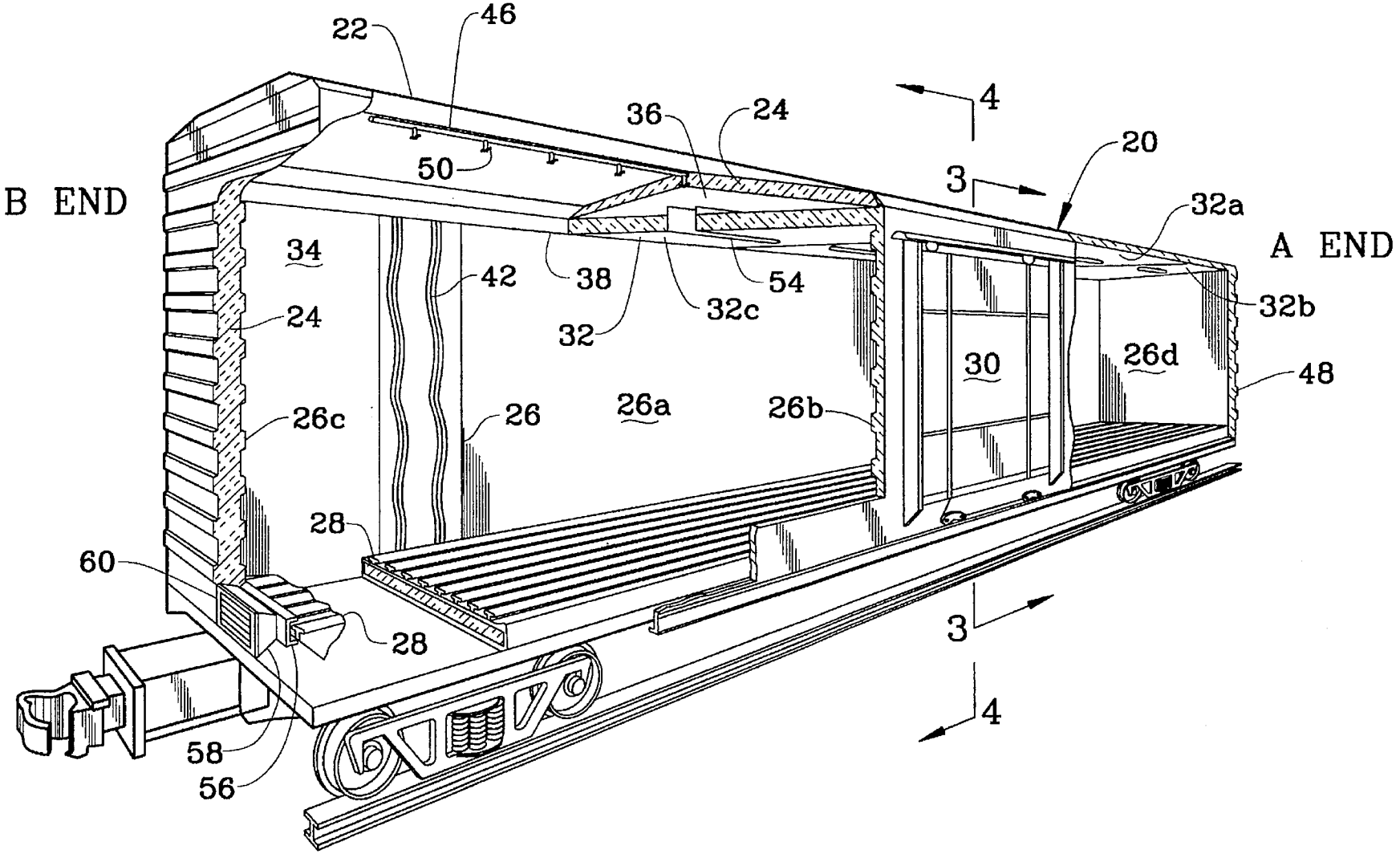

NOTE: In all drawings where carbon dioxide flow is shown, a three headed arrow indicates solid and vapor phases flowing together; a two headed arrow indicates solid phase flowing; and a single headed arrow indicates vapor phase flowing. Where the solid phase is shown in section, the symbol for "chemical solution, gases or their like" is used. Where flow is towards the viewer, a circle with a dot in the center is used, where away from the viewer, a circle with a plus mark in the center is used.

FIGS. 1, 2, 3, 4, 5 & 6 show a refrigerated railcar 20 constructed in accordance with the present invention. First looking primarily at FIG. 1, the railcar 20 comprises a conventional exterior outer shell 22, insulation 24, inside paneling 26, and a channeled cargo floor 28. The paneling 26 includes side walls **26*a*, 26*b*, and end walls 26*c* and 26*d*. A sliding door 30 is provided centrally on at least one side wall of the railcar 20. A false ceiling/bunker floor 32 is provided to divide the inside of the railcar 20 into a cargo compartment 34 and a bunker compartment or area 36. The bunker floor 32 comprises individual panels 32*a* and 32*b* arranged side to side inside the railcar 20, with panels 32*a* between one panel 32*b* on each end, all supported on lengthwise ledges 38. If desired special panels 32*c* (containing oversized cold convectors 40) are positioned over the door(s) 30. The ledges 38** can be of a plurality of designs including L-shaped brackets.

The wall paneling 26 extends at least from the bunker floor 32 down to the channeled cargo floor 28. The side and end walls **26*a*, 26*b*, 26*c* and 26*d* comprise corrugated fiberglass panels forming rows of sinuous or straight channels 42, open sided toward the interior of the cargo compartment 34. Sinuous channeling is generally preferred because the channels 42** are less likely to become blocked by inadvertently loaded cargo or shifting cargo enroute.

The floor 28 comprises lengthwise channeling underneath the cargo 44. The floor 28 can be a T-type cross sectional shape of the type described in Lemon U.S. Pat. No. 4,091, 743 issued May 30, 1978 or variations thereof, with the flat head portion of the T supporting the cargo thereabove. The Lemon T shapes can, if desired, include a 0° F. phase change material for frozen good use or other cold retention methods so as to enhance the floor's cold retention capabilities. Specifically, the floor material should have at least the thermal conductivity and specific heat properties of iron. Aluminum or magnesium is preferred. To enhance the cold retention characteristics, the floor can be selected from thicker material or inserts can be added. The inserts can be metal rods or can be suitable tubes filled with a material which experiences a liquid/solid phase change at a desired temperature. If the railcar is to be dedicated to 35° F., water can be used as the phase change material. As will be described hereinafter, the channeled flooring 28 is arranged to provide a flow of carbon dioxide vapor therethrough.

Above the bunker floor 32 and generally spanning the length of the railcar 20, is a manifold pipe 46. Railcars are generally described as having an "A" end and a "B" end, with the B end being the end having the brake. The manifold pipe 46 proceeds into the A wall 48 of the railcar 20 and extends downwardly to emerge on the outside of the railcar 20. The manifold pipe 46 serves to conduct a supply of pressurized liquid carbon dioxide into the bunker area 36. Discharge of the liquid carbon dioxide from the manifold pipe is through suitably sized orifices 50 and is an isenthalpic expansion process. When liquid carbon dioxide so expands, a portion becomes vapor, commonly called flash vapor and a portion becomes dry ice, commonly called snow 52. The nozzles or orifices 50 are formed and directed (as will be explained hereinafter) so that the flash vapor and snow 52 tend to separate, with the snow 52 remaining in the bunker area 36 on the upper surface 53 of bunker floor 32 and the vapor escaping by means of centrally located vents 54 preferably located near to and beneath the manifold 46. Vents 54 extend upwards into the bunker area, but not far enough to impede the flow of vapor out of the bunker area during the filling of the bunker with snow.

Approximate liquid $CO_2$ flow rates through various size orifices as a function of equilibrium, temperatures and pressures of liquid $CO_2$.

| Orifice sizes | | Flow - lb./min, from | |
|---|---|---|---|
| diameter in inches | temp F.° pressure, psig | 0 290 | −23° 200 |
| 0.050 | | 3.5 | 1.4 |
| 0.070 | | 8.5 | 6.1 |
| 0.090 | | 14.0 | 11.4 |
| 0.110 | | 20.0 | 16.5 |
| 0.130 | | 26.4 | 22.0 |

NOTE: 1) Data for straight-edged orifices
2) Sub-cooled $CO_2$ will flow faster

At the B end of the car, the channeled floor 28 opens to a vent duct 56 which exits to a vent box 58 which provides an exit for vapor to the outside. A manually operated vent box door 60 closes or opens the exit. A relief duct and burst disc (not shown) may be optionally provided for relieving the bunker area 36 or the cargo compartment 34 of railcar 20 of any overpressure that may occur.

Inserted into the insulation 24 above and below the bunker area 36 and below the cargo floor 28 are AURA flat vacuum panels 62 (see also FIGS. 2, 3 and 4).

Figure 2:
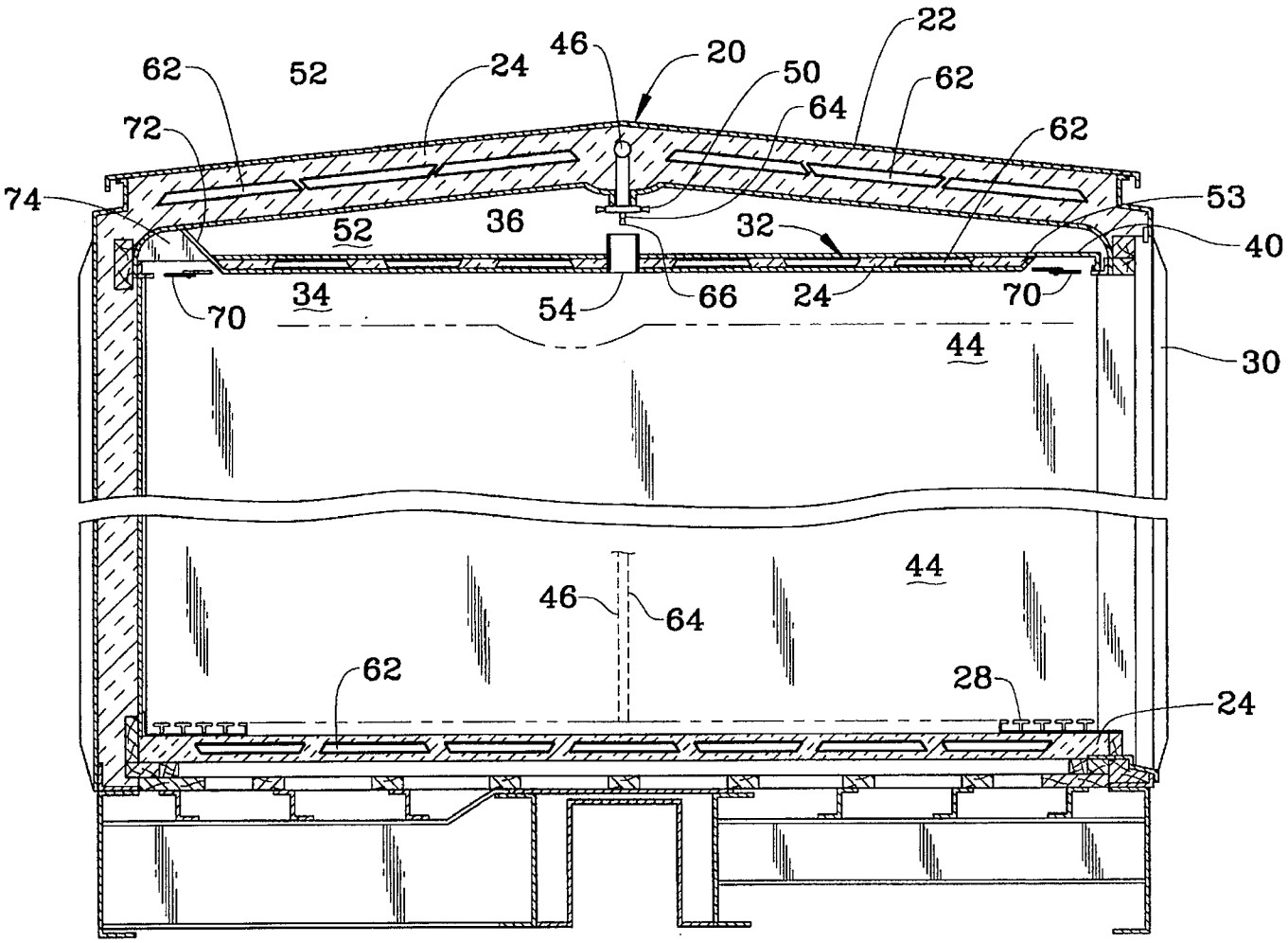
FIG. 2 is an enlarged, fragmentary cross sectional view of the railroad car of FIG. 1, looking in the direction of the arrows 3—3.

FIG. 2 shows the car in more detail looking in the direction of 3—3 of FIG. 1 with the bunker filled with dry ice and the car loaded with cargo 44, all as if enroute. Optional auxiliary manifold 64 is located below manifold 46, and its orifices 66 are directed through the vents 54, and is useful for pre-cooling the railcar or for rapid re-cooling enroute, if required. The right side of FIG. 2 shows simple cold convectors 40 and cold convector dampers 70. The left side shows an alternate cold convector 72 arrangement, which includes extended surface 74 which is provided, so as to provide very cold vapor (denser). Cold convectors 40 are typically thermal extensions of the bunker floor upper surface 53, which is fabricated from a heat conductive material, such as aluminum, and of a thickness (at least 1/32") so that by convection the cold convector surface is maintained at near −110° F. temperature, even as the snow 52 in the bunker sublimes, the bunker floor surface 53 conducting heat through itself from the area where dry ice snow remains to the cold convectors 40, even as the snow 52 becomes used up or if shifting occurs enroute. For the same reasons, bunker panels 32*a*, 32*b* and 32*c* (if used) are preferably connected together so that all floors 32 thermally connect to each other.

Figure 3:
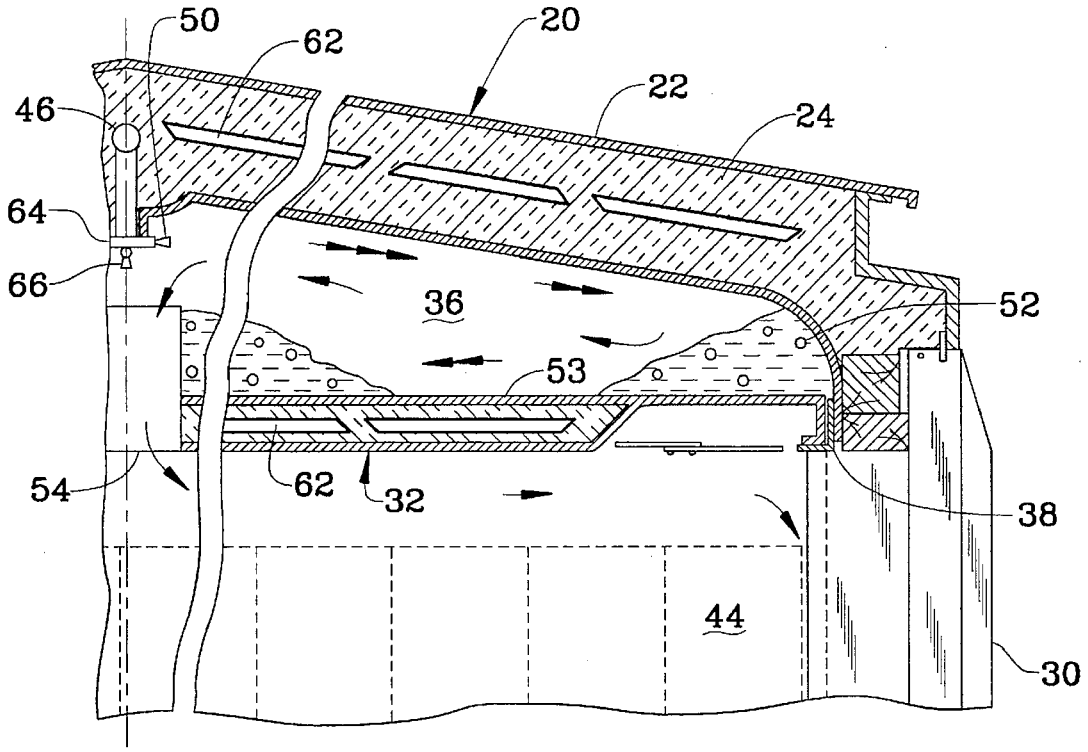
FIG. 3 is an enlarged, fragmentary cross sectional view of the bunker containing portion of the same railroad car of FIG. 1 taken generally along line 3—3.
Figure 4:
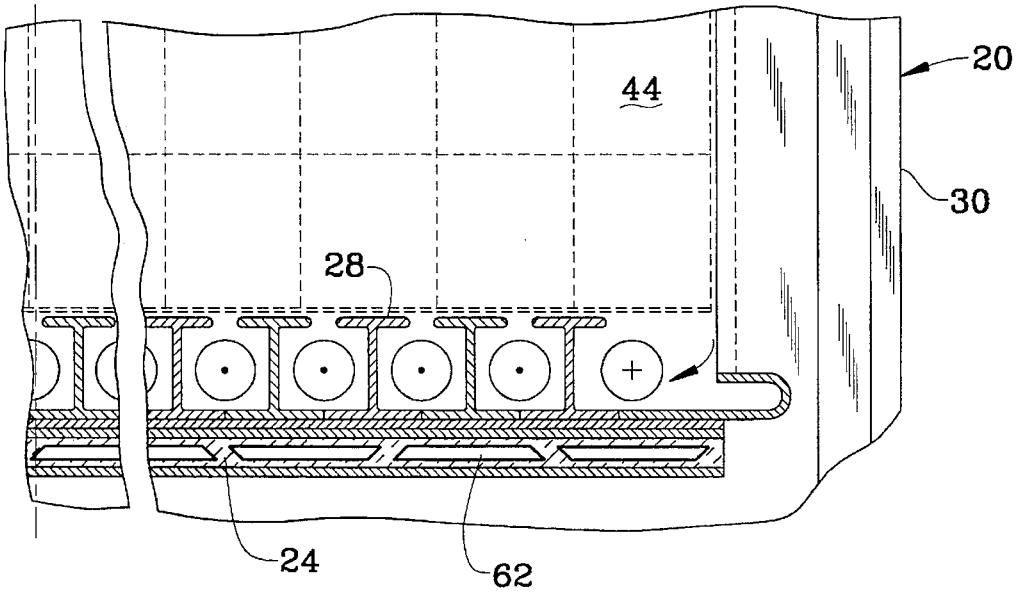
FIG. 4 is an enlarged, fragmentary cross sectional view of the railroad car floor of the same railroad car of FIG. 1, looking in the direction of the arrows 3—3.

FIG. 3 and FIG. 4 show the car 20 of FIG. 2 when filling the bunker 36 with solid carbon dioxide (snow 52), with flash $CO_2$ vapor passing through the floor 28 before exhausting to the atmosphere.

Figure 5:
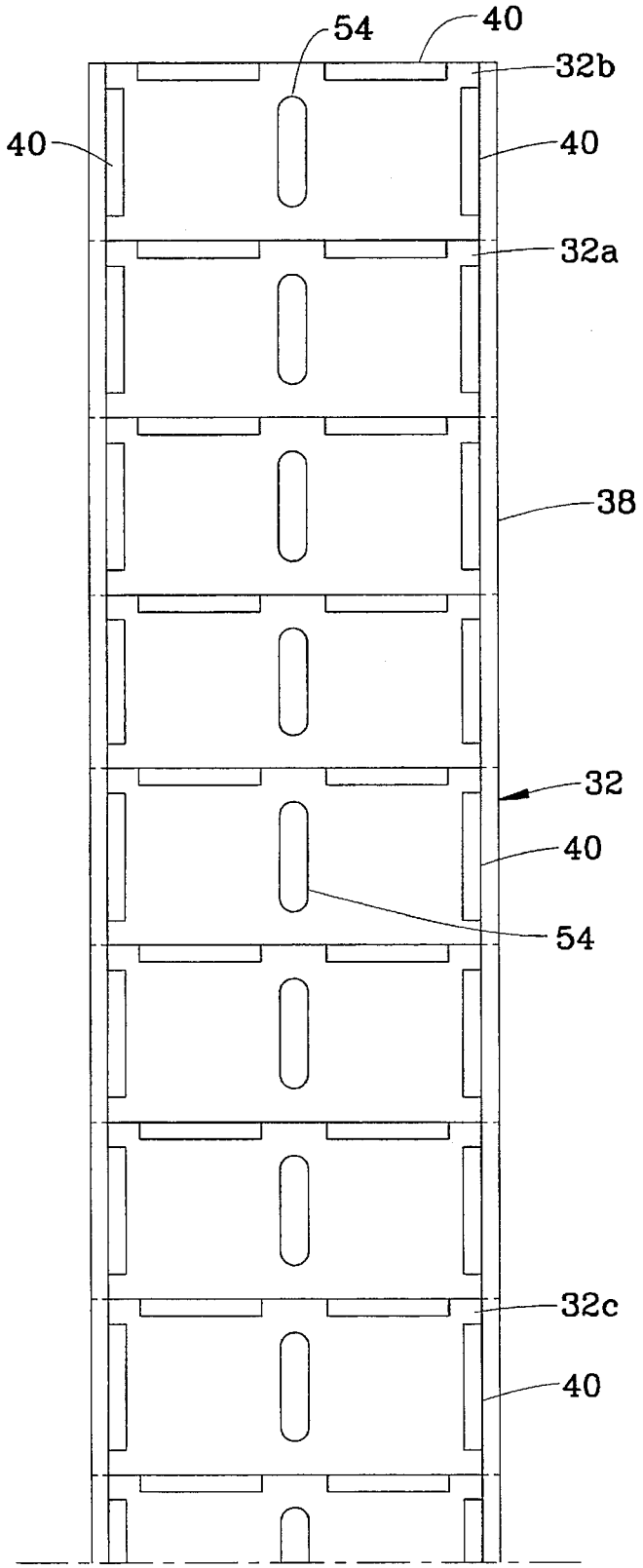
FIG. 5 is a half-length plan view of the bunker floor of the railroad car of FIG. 1, showing the location of 16 vent holes (standard car) and the location of cold convectors in the bunker floor.

FIG. 5 shows a half length plan view of the bunker floor 32 looking upwards from the cargo compartment 34, showing the preferred locations of the cold convectors 40, placed adjacent or not far from (not shown) the side and end walls 26*a*, 26*b*, 26*c*, and 26*d*, vents 54 (near the lengthwise centerline), and location of panels, 32*a*, 32*b* and 32*c* (if used).

Figure 6:
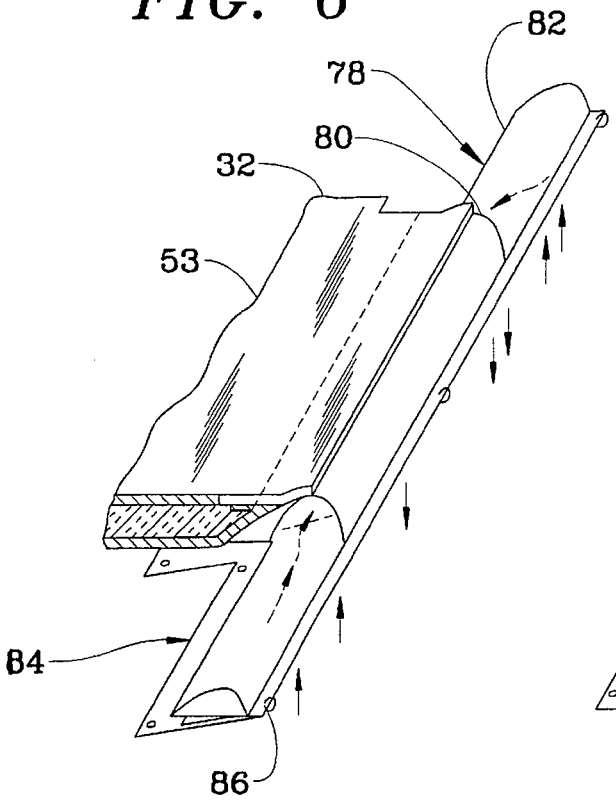
FIGS. 6, 6A, 6B & 6C are enlarged views of a typical cold convector.

FIG. 6 shows a second alternate cold convector 78 as it would appear looking downward and as connected so as to have a good thermal bond to the bunker floor upper surface 53 of the bunker floor 32. The cold convector 78 has three chambers, a center convector cooling chamber 80 with a return vapor chamber 82 on either side, each cold convector or return chamber 82 collecting the rising warmer vapor from the railcar and returning it to the center convector portion 80 for subsequent cooling resulting from the subliming dry ice 52 in the bunker and then dropping the re-cooled vapor to the cargo compartment 34. Of course, for comers or other special locations of the railcar, the cold convector 78 could be made with just two chambers, one cold convector chamber 80 and one return vapor chamber 82.

Figure 6A:
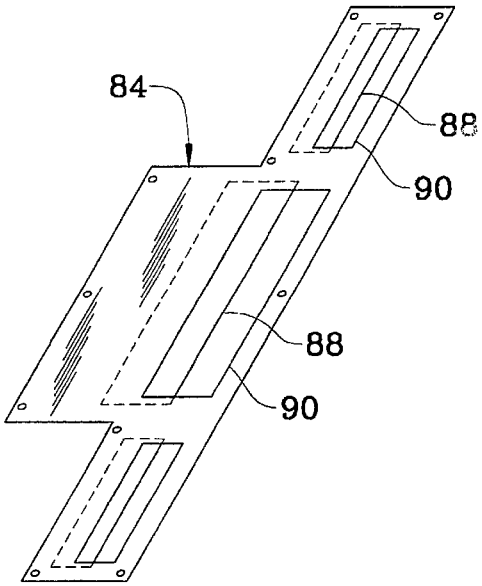

FIG. 6A is a cover 84, hinged to the cargo side by hinges 86 so as to allow cleaning, containing adjustable dampers 88 covering, to the extent desired by anticipated weather conditions or constructional details, openings in the cover 90 which communicate from the cargo compartment 34 to the interior of the cold convector 78.

Figure 6B:
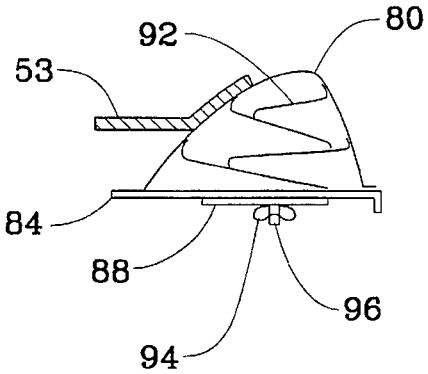

FIG. 6B is a cross sectional view of the center cooling chamber 80 of the second alternate cold convector 78 showing the extended surface plates 92 which cool the returned vapor. Also shown are wing nut 94 and screws 96 which are used to control the opening of adjustable dampers 88.

Figure 6C:
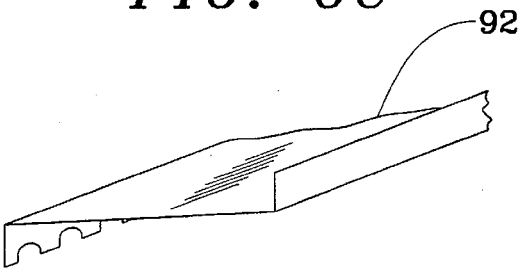

FIG. 6C is a detail of a typical metal plate 92 illustrating one method of restraining flow by providing wiers so as to achieve colder and more dense vapor from the cold convector 78. The cover 84, the return vapor sections 82 and dampers 88 are made of insulating material, so as to both encourage all cooling in the center convector chamber 80 and to reduce heat transmission when they are closed, but the center convector chamber 80 and the plates 92 are made of good heat conductive materials.

Figure 7A:
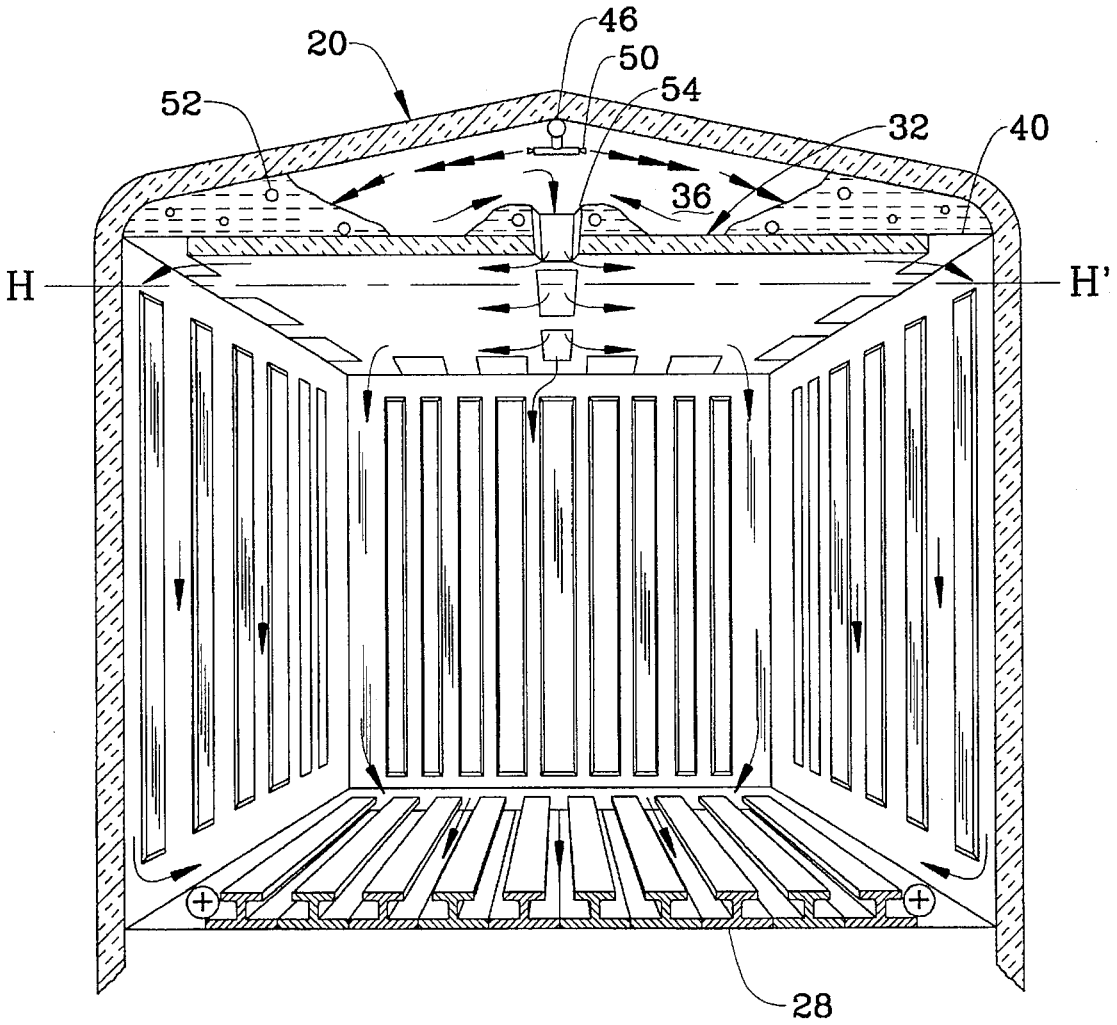
FIGS. 7A & 7B are views depicting the flow patterns of $CO_2$ vapor of the A end and the B end respectively of the railroad car when charging the railcar's dry ice bunker with dry ice snow, as if the car was loaded with cargo.

FIG. 7A is an enlarged fragmentary perspective view of the interior of the A end of the railcar 20 of FIG. 1 generally along lines 3—3, the arrows showing the vapor flow occurring during bunker filling and as if the railcar was loaded with cargo 44, tightly to the side and end wall panelling 26 and to a height about 6 or so inches from the ceiling, indicated by line H–H' and with the vent box door 60 open.

Figure 7B:
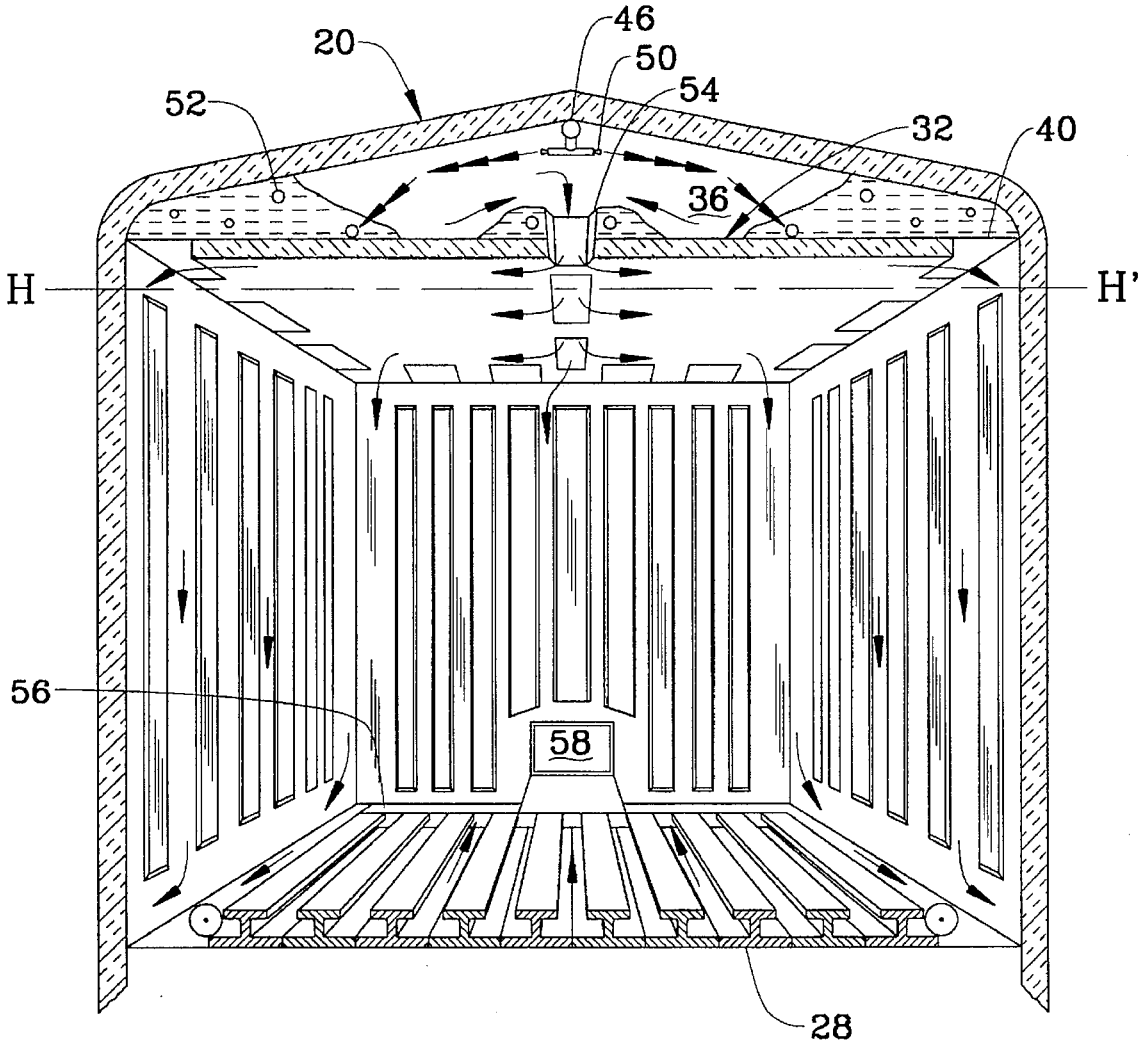

FIG. 7B is an enlarged fragmentary perspective view of the interior of the B end of the railcar generally along lines 4—4 and under the identical conditions as FIG. 7A.

Figure 8:
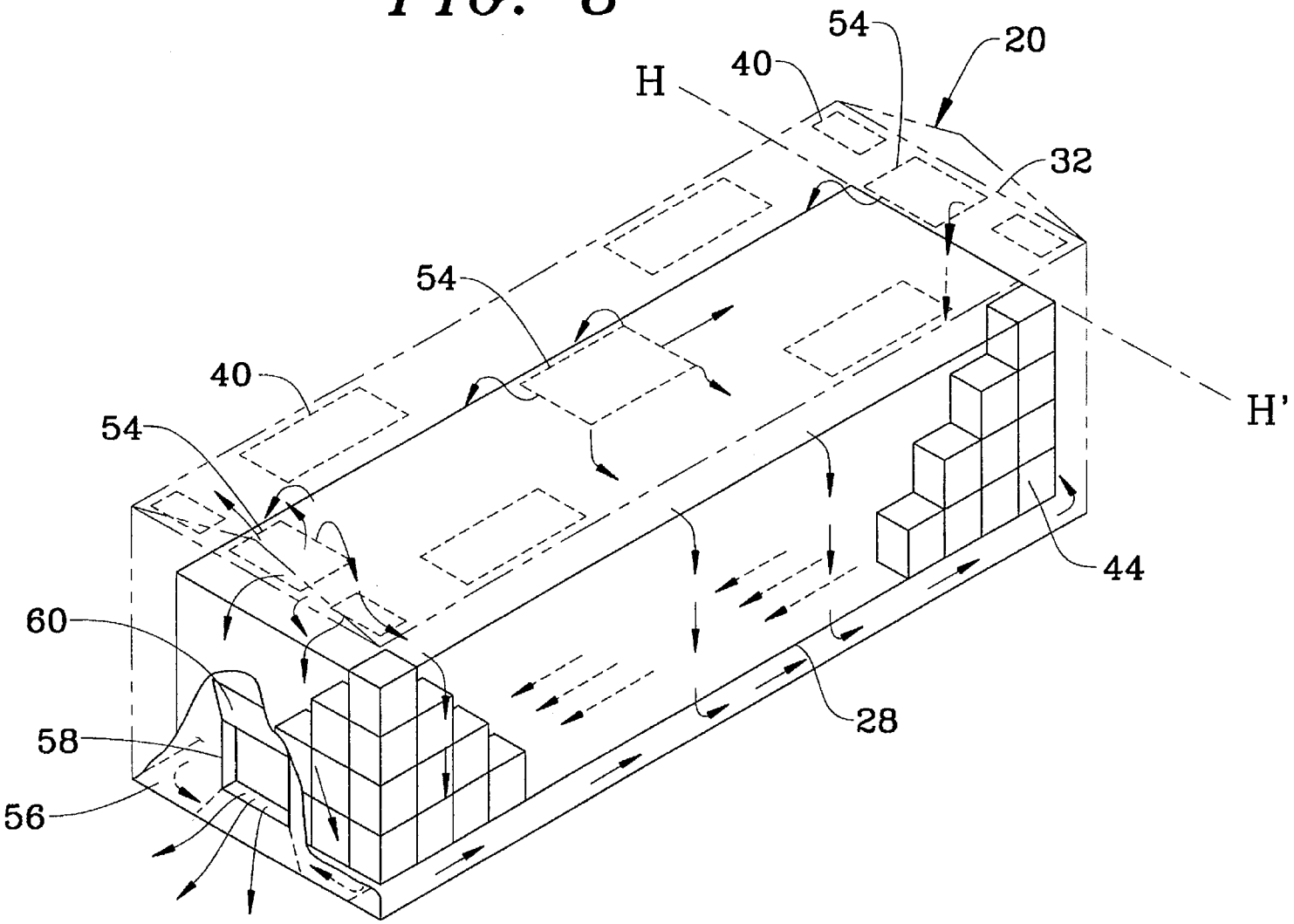
FIG. 8 is a simplified, reduced, perspective view depicting the flow patterns of $CO_2$ vapor when charging the railcar's dry ice bunker with dry ice snow gas if the car was loaded with cargo.

FIG. 8 is a perspective view of the entire railcar under the same conditions as FIGS. 7A & 7B, except the railcar's details have been simplified for clarity.

Figure 9A:
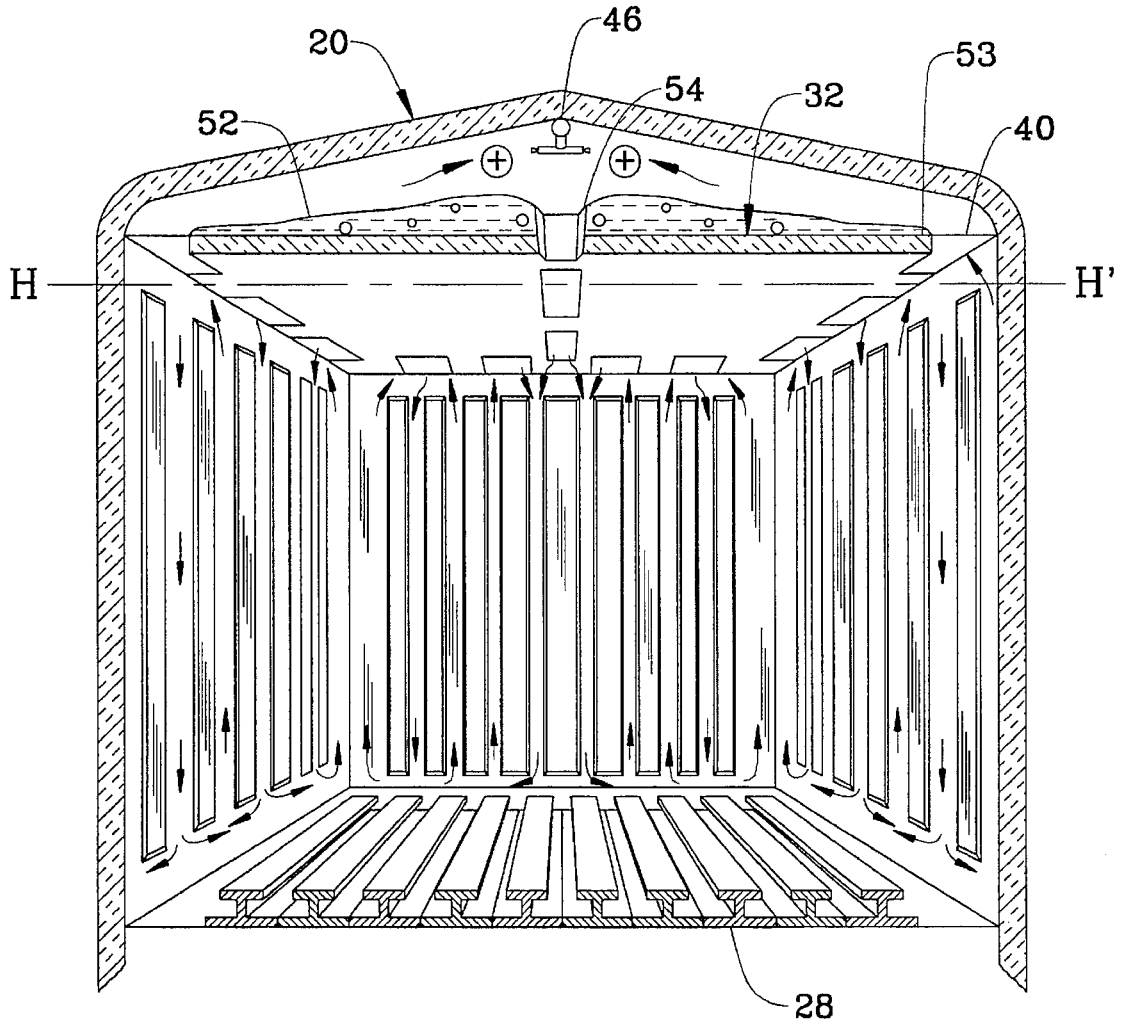
FIGS. 9A & 9B are views depicting the flow patterns of $CO_2$ vapor of the A end and B end respectively of the railroad car when bunker filling has been completed, as if the car was loaded with cargo.

FIG. 9A is an enlarged fragmentary perspective view of the interior of the A end of the railcar of FIG. 1, generally along lines 3—3, the arrows showing the vapor flow occurring when the railcar is enroute, and as if the railcar was loaded with cargo, tightly to the side and end wall panelling 26 and to a height of 6 or so inches from the ceiling, indicated by line H–H', and with the vent box door 60 closed and on track wherein the A end is lower than the B end.

Figure 9B:
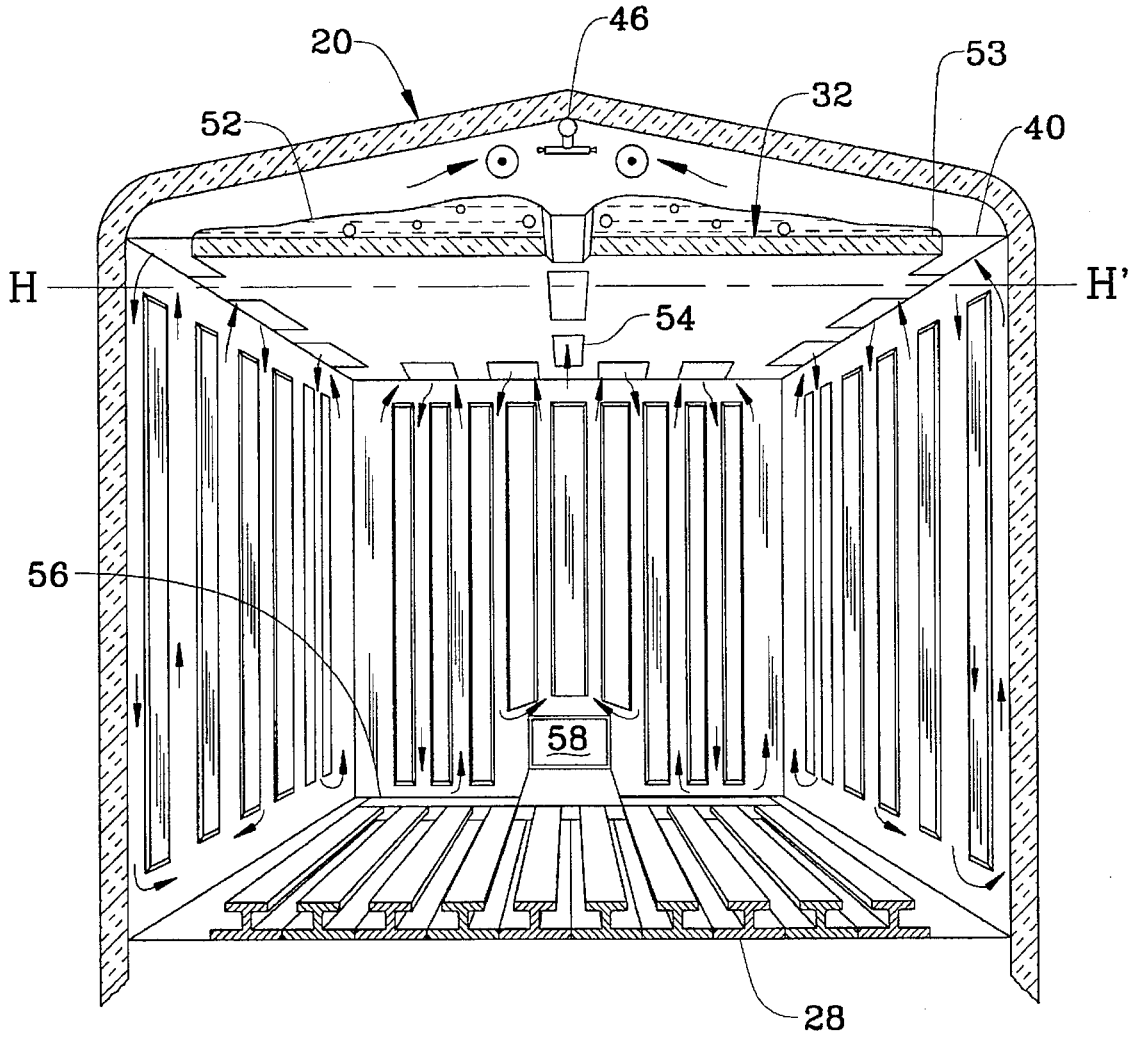

FIG. 9B is an enlarged fragmentary perspective view of the interior of the B end of the railcar generally along lines 4—4 and under the identical conditions as FIG. 9A.

Figure 10:
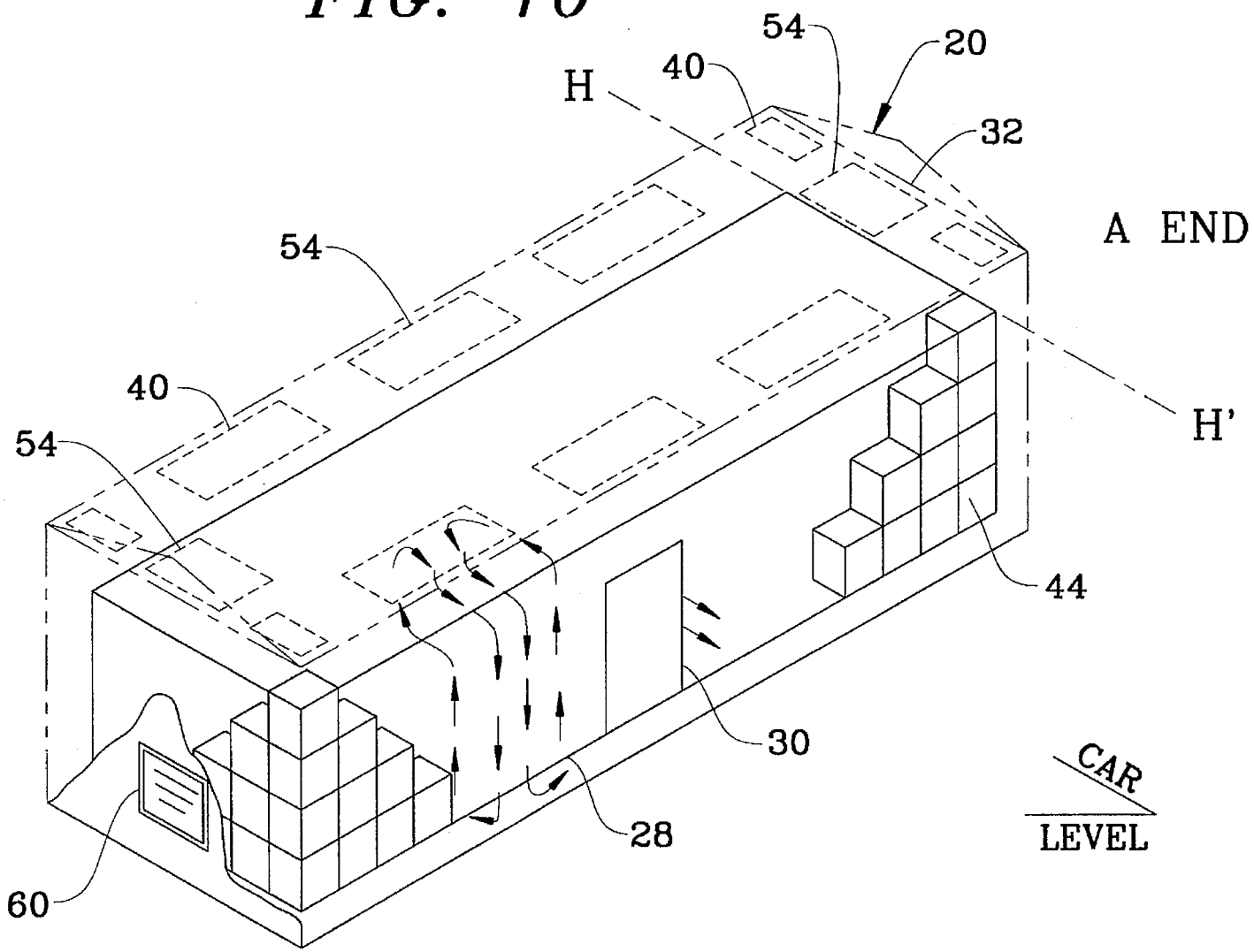
FIG. 10 is a simplified, reduced, perspective view depicting the flow patterns of $CO_2$ vapor when bunker filling has been completed, as if the car was loaded with freight but showing an alternate bunker and manifold pipe arrangement.

FIG. 10 is a perspective view of the entire railcar of FIG. 1 under the same conditions as FIGS. 9A & 9B, except the railcar's details have been simplified for clarity, and the vapor flow of only one cold convector is depicted. It is assumed vapor exhausts the car by leakage around the door seals.

FIGS. 7A, 7B, 8, 9A, 9B and 10 show how the invention functions during both modes of operation, with carbon dioxide directional movement depicted by the appropriate arrows. FIGS. 7A, 7B and 8 show the movement of carbon dioxide solid and carbon dioxide vapor as occurs once the cargo is loaded and when the bunker 36 is being filled with dry ice snow 52, and vent door 60 is open, and consequently vapor passes around and under the cargo before venting to the atmosphere. FIGS. 9A, 9B and 10 show the movement of carbon dioxide vapor, due both to re-cooling and sublimation, which occurs once the bunker 36 has been filled with snow 52, the vent box door 60 is closed, and venting to the atmosphere is minimal. These views assume the railcar 20 is loaded with cargo, is enroute, and the "A" end of the car is lower than the "B" end, due to the terrain at the moment. Both FIGS. 8 and 10, for aid in depiction do not show all the vents 54 and cold convectors 40 shown in the other views. In addition FIG. 10 shows vents 54 and cold convectors 40 in an alternate arrangement wherein they are all located adjacent or not far from the side and end walls 26*a*, 26*b*, 26*c* and 26*d*. In such an arrangement, it may be desired (not shown) to have a divided manifold pipe 46, one leg on each side of the bunker, their orifices 50 facing each other.

Theory of Operation—Carbon Dioxide Railroad Car Refrigeration System

The theory of operation of this carbon dioxide refrigerated or frozen food in transit system is much different from any previously used on railroad cars, similar vehicles, or containers. It functions by uniquely combining two different effects: 1) the cooling provided by the flash gas generated during bunker filling with 2) the use of the refrigeration enroute of the subliming carbon dioxide in the bunker and of the resultant vapor; all in a mutually supporting manner so as to create a passive and effective envelope type refrigeration system useful for substantial enroute times. It first recognizes the conditions of modern carbon dioxide manufacture and sale, where most users' supply is in the form of liquid carbon dioxide (readily stored and distributed through pipes by the user at nominal 0° F. and 300 p.s.i.a.), rather than in the form of dry ice blocks (compressed "snow", at −110° F. and atmospheric pressure and requiring substantial manual material handling). Typical users of carbon dioxide today have a large quantity of liquid carbon dioxide stored at the using site and pipe it to the using point. If dry ice is desired, the liquid is expanded through orifice devices (in some cases including congealing devices known as "snow horns"), to atmospheric pressure changing in the process to a mixture of solid and vapor. A form of solid dry ice results, known as "snow", as it greatly resembles natural water snow, except it is much colder (−110° F.) and has a very large heat of sublimation (244 BTU per lb.) occurring as it turns directly to vapor when heated. The vapor portion initially is also @−110° F., but only has a sensible cooling capability of about 22 BTU per lb. when warmed to 0° F. A variety of carbon dioxide using devices cool in this manner and some examples are described in U.S. Pat. Nos. 3,660,985; 3,672,181; 4,344,291; 4,356,707; & 4,695,302 all issued to Lewis Tyree Jr.

Modern practice for railroad cars is to expand liquid carbon dioxide through an orifice or an orifice like device (so as to create the desired dry ice) inside a bunker which in turn is inside the car, extending above the ceiling of cargo area, just as an attic in a house. However, in doing so, approximately one half the liquid carbon dioxide flashes to −110° F. vapor at the same time the dry ice snow is being created, i.e. during the bunker filling operation, and this vapor must be allowed to rapidly escape, or severe pressure build-ups occur. For such applications where the bunker is large, the orifice device's exit bore is extended and then counterbored with a taper reamer, or similar method, creating a smooth, conical exit path. This aids in congealing the snow, giving directional velocity to it and results in less float. The dry ice remaining in the bunker provides the enroute cooling.

This invention recognizes that accordingly, such a vehicle carbon dioxide dry ice bunker or attic system requires two separate, distinct and quite different operating modes, but that must each function from the same bunker system and in a complementary manner. While the invention is useful for both refrigerated products (i.e. 35° F. or so) or frozen products (i.e. 0° F.), the following explanation is for frozen products. Both modes utilize the fact that most frozen foods can be substantially sub-cooled (below 0° F.) without damage, but cannot be allowed to warm up much above 20° F. (and some even should be maintained colder, i.e. cold water fish and others). The first operating mode, occurring when filling the bunker, is directed at utilizing the approximately one half of the incoming liquid carbon dioxide which flashes to vapor at −110° F. (the other one half becoming dry ice snow), rapidly creating a great quantity of this very cold vapor, which must immediately exit the bunker. To best utilize this very cold vapor, the cargo is loaded (prior to filling the bunker) tightly to all sides, but with a space above the cargo, just below the attic bunker. This space is needed for two reasons, first providing for the fork lift room to carry pallets of cargo into the vehicle during loading (or off during unloading) and in addition to provide a plenum for the flash vapor to enter the cargo area from the bunker and to then evenly disperse itself to the four side walls. The side walls are constructed with open to the interior three-sided channels, as is the floor (thus when the cargo is snugly in place, cooperatively forms four sides). This one side open channel feature is most useful, being of great value when cleaning the car between uses. The bottom of the side walls have a manifold-like open connection and are so arranged when the car is loaded, to form passages so the flash vapor driven down the side and end walls by pressure differential exits from the side and end walls and is gathered to one end where it then passes through the floor channels before exiting the car through a vent sufficiently large to readily accommodate the flash vapor. The floor channels are typically metal so as to better hold and retain the cooling effect of the flash vapor passing through it. Thus, this portion of the invention utilizes the flash vapor to effectively sub-cool both the interior surfaces of the sides and floor (and to also simultaneously sub-cool that portion of the cargo next adjacent to the sides and floor). This sub-cooling of the floor area during bunker filling is most important as it acts as a future barrier to enroute heat incursion. Accordingly the floor, where enroute heat incursion is great, is preferably made of heavy aluminum or other heat retention materials, so as to maximize the future barrier effect.

The second operating mode occurs once the bunker is filled and the car is enroute. Very little vapor is created from the dry ice in the bunker as it sublimes, but a great deal of refrigeration is produced, as, on a pound for pound basis, over 10 times the refrigeration is available from sublimation as from warming the −110° F. sublimed vapor (see Table). Accordingly, to best utilize this subliming effect so as to promote vapor circulation in the cargo compartment, cold convectors or very cold portions of the dry ice containing bunker floor/cargo ceiling, are provided. These cold convectors are located so the ability of the subliming dry ice to re-cool cargo compartment vapor is preferential to where it is most required, i.e. to intercept side and end wall and floor edge heat incursions before they reach the cargo. Thus the cold convectors are provided all around and adjacent the four sides, so the vapor cooled by the action of the cold convectors is sufficiently dose to all sides that each (and the outer edges of the floor) receives its benefits, despite the fact that the car isn't always level, as the track is frequently sloped front to rear or side to side to fit the terrain the railcar traverses. The periphery of the cargo is thus protected (the bunker protects the top) by both the natural tendency of warm vapor to rise and cold vapor to sink. Since both these actions are caused by relative density (in this case, a function of the vapor's temperature, as the interior of the railcar quickly becomes 100% carbon dioxide vapor), the cold convectors are arranged and located so as to be effective by providing a number of small falling streams of very cold vapor down each of the side and end walls, much as a series of small waterfalls operate (as opposed to larger streams of slightly cold vapor), no matter whether the railcar is level or not. These cause a substantial downflow effect through some of the side and end wall channels to the bottom manifolds, where warmer vapor is displaced back up to the cold convectors through nearby channels. Most prior systems operate on vapor warmed by heat incursion rising and then being cooled, but with frozen foods, undesirable warming of the foods can occur before a meaningful warmer vapor density difference occurs (see Table). However, with dry ice cooled cold convectors, meaningful colder differences (and density differences) can be created, as frozen foods can tolerate much greater temperature differences below 0° F. than above 0° F. In a related improvement, the cold convectors are provided with adjustable dampers so that the volume and/or temperature of vapor being re-cooled can be adjusted for a number of reasons including: seasonably (more and/or colder vapor in summer, less and/or warmer vapor in winter), to compensate for known high heat incursion areas, i.e. around the doors or comers. In another related improvement, the cold convectors are arranged with extended surface on their cargo side, in a manner that is able to promote very cold exit temperatures of the vapor and thus very dense vapor and enhanced downward circulation. The cold connectors can be a variety of designs, from complex to simply extensions of the heat conductive bunker floor top surface.

The bunker is specially arranged with an array of center flash gas vents, ensuring improved dry ice snow dispersion during filling of the bunker. In addition, arranging for the flash gas to enter the plenum in its center tends to produces gas/vapor flow more evenly down all sides (dispersing itself through the multitude of channels), thence through the floor, all as the vapor seeks the large flash vent exit during both bunker filling. The enroute sublimed vapor vent exit (not shown) is much smaller than the flash vapor vent and also provides a small back pressure, and encourages venting, if occurring (although door seal leaks, etc. may dominate) after passing under the cargo. A positive pressure inside the car enroute is desirable, so outside air infiltration due to wind velocities, train speed, etc. is prevented.

Other improvements include the use of AURA high R vacuum flat insulation panels or similar enhanced insulation panels, in areas of great utility, either where heat incursion is most difficult to counteract by re-cooling the vapor, such as the railcar's floor, or their use in the car roof where the sun's radiant heat is the greatest or in the dry ice bunker floor, so as to increase the effect of the cold convector portion and reduce the floor's general cooling effect to the top of the cargo.

Another improvement is providing a separate liquid carbon dioxide manifold, located directly above the main center vents and spraying dry ice snow and vapor downward through them; so as to either pre-cool the car before loading, if desired, or to re-cool the car and cargo enroute, if needed.

Although the invention has been described in considerable detail with particular reference to a preferred embodiment, variations and modifications can be effected from the above disclosure by those skilled in the art who carefully review it. Therefore, the present invention is not to be limited by the above description, but is to be determined by the spirit and scope of the following claims.

I claim:

1. In an insulated railroad car or other cargo container having an internal cargo volume of at least 600 cubic feet, for maintaining cargo in a refrigerated condition by the use of carbon dioxide as an expendable refrigerant, the car or container having a top, a pair of opposed side walls, a bottom and a bunker having a floor and a vent(s) for carbon dioxide vapor, the bunker positioned beneath the top and above a cargo volume, a manifold pipe positioned so as to provide a supply of carbon dioxide snow on the floor of the bunker, the bunker floor providing a ceiling for the cargo volume, the improvement comprising an area of heat conducting material as the upper surface of the bunker floor to be maintained at a near uniform temperature from contact with the carbon dioxide snow in the bunker, said heat conducting material to be in direct thermal communication with both the carbon dioxide snow in the bunker and convectors located in or near the ceiling of the cargo volume and adjacent to the side and end walls, said convectors generally surrounding a layer of insulation in the bunker floor between the heat conducting material and the cargo volume; whereby the cargo is uniformly maintained in a refrigerated condition.

2. The railroad car or container of claim 1 wherein adjustable dampers are provided at least in part covering the convectors communicating with the cargo volume so that more or less cooling is directed to the sides and ends of the cargo volume when it is anticipated such more or less cooling rate is advantageous.

3. The railroad car or container of claim 2 wherein extended surfaces are part of the convectors so that greater cooling of the carbon dioxide vapor in the cargo volume is provided.

4. The railroad car or container of claim 1 wherein the heat conducting material is in the form of a metal panel having a thickness of at least 1/32 inch.

5. The railroad car or container of claim 4 wherein the heat conducting metal panel has a thermal conductivity equal to or greater than iron.

6. The railroad car or container of claim 5 wherein the metal is selected from the group consisting of iron, copper, aluminum, magnesium and alloys thereof.

7. The railroad car or container of claim 5 wherein the metal is selected from aluminum and alloys thereof.

8. The railroad car or container of claim 1 wherein the bunker vents communicate to the cargo volume, the cargo volume side and end walls are corrugated to the inside and the floor is also corrugated to the inside, an exhaust vent in communication with the corrugations, the corrugations connected so if the exhaust vent is open, carbon dioxide vapor can flow from the bunker downward through said wall corrugations around the cargo as well as passing under the cargo before passing through the exhaust vent to the atmosphere.

9. The railroad car or container of claim 8 wherein the car floor includes means to retain for later use of the cooling effect of the carbon dioxide vapor passing through said floor.

10. The railroad car or container of claim 8 wherein a second manifold pipe is included which injects carbon dioxide snow through the bunker vents into the cargo area, whereby said car may be precooled before loading or said cargo volume rapidly re-cooled enroute if said bunker became empty of snow.

11. The method of maintaining cargo in a refrigerated condition in an insulated railcar or container by the use of carbon dioxide as an expendable refrigerant, wherein liquid carbon dioxide is injected into a carbon dioxide bunker forming snow which remains in said bunker and vapor which exits said bunker through a vent(s) into a cargo compartment loaded with cargo, said cargo being arranged so that a substantial open space is formed between said cargo and the bottom of said bunker and said vents, and then by said cargo and under said cargo to an exhaust vent to the outside, wherein the impovement comprises subsequently providing cooling from sublimation of said snow to said cargo compartment principally by means of heat conducting material in thermal communication with both said snow and convectors located adjacent to the end and side wall of said cargo compartment, and reducing the cooling from sublimation of said snow to said cargo by positioning a layer of insulation in a bottom area free of vents and convectors of said bunker.

12. The method of claim 11 wherein the improvement further comprises controling the amount of cooling provided by adjusting dampers cooperating with said convectors.

13. The method of claim 11 wherein open to the interior channel like corrugations in the end and side walls and in the car floor communicate in a manner so that carbon dioxide vapor, created during filling the bunker with snow, passes through said end and side walls and said floor and through said exhaust vent to the outside; and carbon dioxide vapor created during the sublimation of the snow and the carbon dioxide cooled or that to be cooled by the heat conducting material can circulate down and up said side and end wall channels.

14. The method of maintaining cargo in a refrigerated condition in an insulated railcar or container by use of solid carbon dioxide as an expendable refrigerant wherein liquid carbon dioxide is injected into a bunker located above a cargo compartment, creating vapor and solid phase (snow) carbon dioxide, the vapor created during such injection cooling a portion of both the cargo and the cargo compartment prior to vent to the atmosphere, and said carbon dioxide subsequently cooling said cargo compartment, wherein the improvement comprises cooling primarily sides and ends of the cargo compartment during the subsequent cooling period primarily by sublimation using heat conducting material in thermal communication with both said snow and convectors located adjacent to the end and side walls of said cargo compartment, and reducing the cooling from sublimation of said snow to said cargo by positioning a layer of insulation in a bottom area free of vents and convectors of said bunker.

15. The method of claim 14 wherein the improvement further comprises adjusting dampers cooperating with said convectors to control the amount of cooling provided.

16. The method of claim 14 wherein the improvement further comprises venting carbon dioxide vapor from the bunker down ducting in one or more of the side and end walls of said cargo compartment and under the floor of said compartment and then venting the vapor to the atmosphere.

* * * * *